US005714995A

United States Patent [19]

Wiklof et al.

[11] Patent Number: 5,714,995

[45] Date of Patent: Feb. 3, 1998

[54] THERMAL PRINTHEAD WITH ENHANCED REMOTE VOLTAGE SENSE CAPABILITY

[75] Inventors: Christopher A. Wiklof; Pixie A. Austin, both of Everett; Joseph R. Wade, Monroe; Melanie Zerbe Pate, Kirkland, all of Wash.

[73] Assignee: Intermec Corporation, Everett, Wash.

[21] Appl. No.: 715,993

[22] Filed: Sep. 19, 1996

Related U.S. Application Data

[60] Division of Ser. No. 126,284, Sep. 23, 1993, Pat. No. 5,625,401, which is a continuation-in-part of Ser. No. 951, 780, Sep. 25, 1992, abandoned.

[51] Int. Cl.[6] ..... B41J 2/335; B41J 2/345

[52] U.S. Cl. ..... 347/208; 347/209

[58] Field of Search ..... 347/208, 209

[56] References Cited

U.S. PATENT DOCUMENTS

| | | | |
|---|---|---|---|
| 4,368,420 | 1/1983 | Kuo | 323/303 |
| 4,855,757 | 8/1989 | Wiklof et al. | 346/76 |
| 4,972,205 | 11/1990 | Nagato | 347/200 |

FOREIGN PATENT DOCUMENTS

| | | |
|---|---|---|
| 54-30849 | 5/1979 | European Pat. Off. . |
| 61-185464 | 8/1987 | European Pat. Off. . |
| 62-297161 | 6/1988 | European Pat. Off. . |

*Primary Examiner*—Huan H. Tran

*Attorney, Agent, or Firm*—Seed and Berry LLP

[57] ABSTRACT

A thermal printhead formed on a substrate. The plurality of thermal print elements in the thermal printhead are formed in a linear array. Each of the plurality of thermal print elements is respectively connected to a plurality of common electrode traces and a plurality of ground electrode traces. The common electrode traces are switchably connected to a single common electrode and the ground electrode traces are connected to a single ground electrode. The common electrode is held at a common voltage and the ground electrode is held at a ground voltage. The electrical circuit includes at least one common remote sense electrode connected to the single common electrode and, optionally, at least one ground remote sense electrode connected to the single ground electrode.

22 Claims, 11 Drawing Sheets

DI, DO, STR: n = 6 DOT: a = 1408 dots

| n | DOT No. | dots/STR |
|---|---|---|
| 1 | 1 – 123 | 128 |
| 2 | 123 – 384 | 256 |
| 3 | 385 – 640 | 256 |
| 4 | 641 – 896 | 256 |
| 5 | 897 – 1152 | 256 |
| 6 | 1153 – 1408 | 256 |

THERMAL PRINTHEAD WITH ENHANCED REMOTE VOLTAGE SENSE CAPABILITY

CROSS-REFERENCES TO RELATED APPLICATIONS

This application is a divisional of U.S. patent application Ser. No. 08/126,284, filed Sep. 23, 1993, now U.S. Pat. No. 5,625,401, which is a continuation-in-part of U.S. patent application Ser. No. 07/951,780, filed Sep. 25, 1992, now abandoned.

TECHNICAL FIELD

The present invention relates to thermal printheads, and more particularly to thermal printheads that have an improved electrical performance.

BACKGROUND OF THE INVENTION

A thermal printer operates by sequentially heating desired patterns of small discrete areas ("pixels") of a thermal medium to produce desired light and dark patterns on the thermal medium. In some instances, the thermal medium can be a thermally sensitive medium which is heated directly, while in other instances, the thermal medium can be a thermal transfer ribbon which is heated to cause a small amount of dyed wax to be transferred to a medium which is not thermally sensitive.

The discrete areas of the thermal medium are heated by a thermal printhead which includes an array of minute, closely spaced resistive dots (or thermal print elements) that can be individually thermally controlled by means of electrical signals. The thermal medium is stepped past the printhead as each desired linear pattern is printed. The printhead is positioned over each part of the thermal medium for a predetermined interval of time (the "scan line time," SLT) which depends upon the printer's print speed.

In response to the print command signal, each thermal print element in a printhead receives an electrical energization signal that is a composite of two other electrical signals. Specifically, the energization signal is a logical AND of a strobe signal and a data signal. The strobe signal, which is periodically sent to each of the thermal print elements, is tailored to cause the thermal print element to reach and maintain a temperature within a prescribed temperature range under controllable conditions. The strobe signal typically consists of two portions—an initial "burn" time and a subsequent "chopped" time. If the strobe signal were applied directly to the thermal print element, the burn time portion of the strobe signal would force the thermal print element to heat up quickly. The chopped time portion of the strobe signal typically maintains the thermal print element's temperature and consists of approximately 25 cycles of a square wave with a 50 percent duty cycle. The data signal determines whether, within the period of the strobe signal, any portion of the strobe signal should be applied to a thermal print element to cause it to print.

In the past, it was known to adjust the strobe signal to account for the temperature of the printhead. For example, when a printer first begins operation, its printhead is still at ambient temperature and its individual thermal print elements must be given more energy to cause them to print. Therefore the burn time portion of the strobe signal can be lengthened so that the individual thermal print elements will be heated more and the printhead will reach a normal operating temperature. After the printhead has reached its operating temperature the strobe signal can be readjusted for these "normal" conditions.

To maintain high print quality under all of the possible operating conditions, it is necessary to keep the electrical potential across the printing elements in the printhead very well controlled. Presently, the electrical potential is measured between a pin in the connector from the supply printhead drive voltage ($V_{sct}$=COM) and a pin in the connector from the printhead ground voltage ($V_{gnd}$=GND). This potential is used by a sensing circuit in the power supply for the printhead to adjust the power supply voltage. In particular, the sensing circuit adjusts for variations in $V_{sct}$ through a feedback circuit in order to keep to keep $V_{sct}$ relatively constant at the printing elements.

A drawback of the present art is that voltage fluctuations internal to the printhead but not transmitted to the connector pins are not detected. Such internal fluctuations are especially prevalent during periods of heavy printing where many printing elements are turned on simultaneously. These fluctuations have been determined by the inventors to be significant because they degrade the quality of the printing produced by the printhead.

SUMMARY OF THE INVENTION

According to principles of the present invention, a printhead for a thermal printer is provided with a separate voltage sense electrode. The printhead comprises a plurality of thermal print elements. Each thermal print element has a first connection point to a higher voltage source and a second connection point to ground or other lower voltage source. The printhead further comprises a plurality of common electrode traces connecting the thermal print element to the higher voltage source and a plurality of ground electrode traces to selectively connect the thermal print element to ground. Each of the plurality of common electrode traces is respectively connected to the first connection point of each of the plurality of thermal print elements, respectively, and each of the plurality of ground electrode traces is respectively connected to the second connection point of each of the plurality of thermal print elements. All of the common electrode traces are connected to a single common electrode, which is desirably held at a predetermined high value known as the common voltage. Each of the ground electrode traces is connected to a driver, through which it may be switchably connected to a single ground electrode, which is held at a predetermined ground voltage.

The printhead further comprises a voltage sense electrode to permit monitoring of the difference between the predetermined common voltage and the predetermined ground voltage. The electrical circuit includes at least one common voltage remote sense electrode connected to the single common electrode. Optionally, it may include at least one remote ground sense electrode connected to the single ground electrode. The electrical circuit also includes a dedicated sense pin connected to the remote sense electrode for connection to a remote sense circuit. Optionally, it also includes a ground voltage sense pin connected to the at least one remote ground sense electrode.

DETAILED DESCRIPTION OF THE INVENTION

Figure 1:
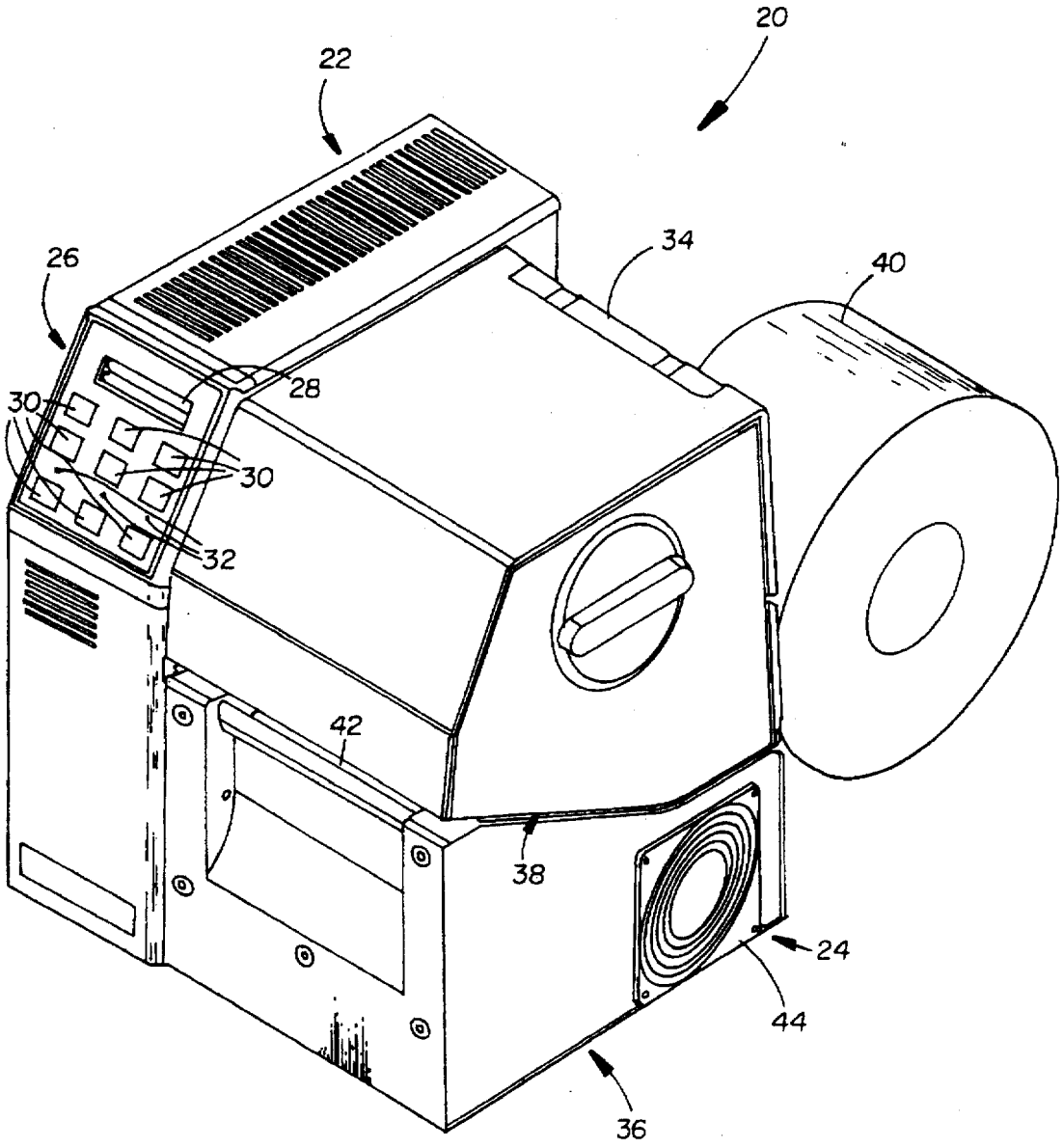
FIG. 1 is a perspective view of a thermal printer.

FIG. 1 is a perspective view of one example of a thermal printer. The thermal printer 20 includes a first housing 22 and a second housing 24. The first housing 22 encloses electrical components, such as electrical motors used in the operation of the thermal printer 20. The first housing 22 also includes a control panel 26 which allows the thermal printer 20 to be controlled and adjusted by a user.

The control panel 26 includes a liquid crystal display (LCD) 28, a plurality of buttons 30, and a plurality of light emitting diodes (LEDs) 32. The LCD 28 provides an alphanumeric display of various commands useful for the user to control and adjust the thermal printer 20. The buttons 30 implement the user's choices of controls and adjustments, and the LEDs 32 provide displays of the status of the thermal printer 20. For example, one of the buttons 30 can be used to toggle the thermal printer 20 on- and off-line, with one of the LEDs 32 indicating when the printer is on-line. Another one of the buttons 30 can be used to select an array of menus that can be displayed in the LCD 28. These menus can include choices of print speeds and media types, among other choices. Still another one of the buttons 30 can be used to reload or advance the print medium through the thermal printer 20. Yet another button 30 can be used to open the printer in order to change the print medium.

The second housing 24 includes a printer module 34 and a motor drive module 36 which are normally latched together. The printer module 34 and the motor drive module 36 are separated by a print medium path 38. By activating another one of the buttons 30, the printer module 34 can be caused to unlatch from the motor drive module 36 and rotate backwards, in a clockwise direction as seen in the view of FIG. 1. This action opens the print medium path 38 and allows the adjustment and replacement of the print medium which is introduced into the print medium path 38 from the print medium roll 40. The print medium supplied on the print medium roll 40 is available in a variety of thicknesses, thermal sensitivities, and materials, depending upon the use to be made of the print medium. The print medium supplied from the print medium roll 40 passes through the print medium path 38 and exits through the opening 42. If the print medium is a thermal transfer medium, a thermal transfer ribbon is placed in a separate drive mechanism contained within the printer module 34. This separate drive mechanism provides supply and take-up rolls for the thermal transfer ribbon, the rolls being separately controllable from the movement of the print medium. This permits saving the thermal transfer ribbon when the pattern to be printed on the print medium contains areas where no printing is required. The motor drive module 36 also contains a cooling fan (not shown) which exhausts air through the grill 44. Of course, this invention is usable with a number of different thermal printers in addition to the one shown in FIG. 1.

Figure 2:
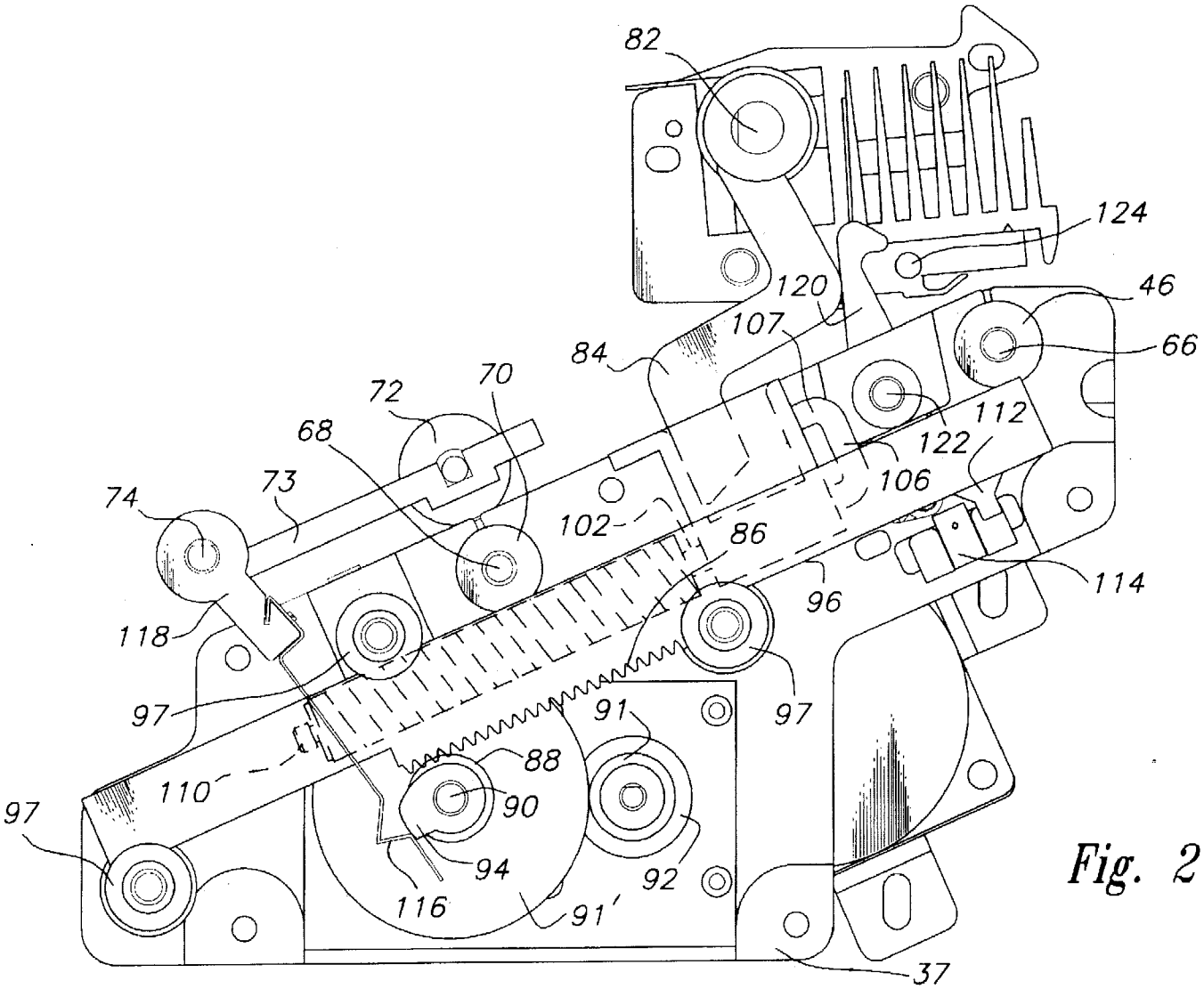
FIG. 2 is an elevational view of a print medium drive mechanism of the thermal printer of FIG. 1.

FIG. 2 is an elevational view of one example of an adjustable printhead pressure mechanism contained within the second housing 24. The printhead pressure mechanism is in a "print" mode.

The printhead pressure mechanism includes a platen roller 46 placed near the position of the opening 42, shown in FIG. 1. The print medium from the print medium roll 40 passes through the print medium path 38 with its printed side facing up. The print medium is advanced through the print medium path 38 by an advancement mechanism and forced to pass between the platen roller 46 and a thermal printhead 80 which is located near the opening 42 (also shown in FIG. 1).

When the printer module 34 is locked in position against the motor drive module 36, the print medium is forced against the printhead 80 by the platen roller 46. In order to accommodate a wide variety of printer media, the pressure between the platen roller 46 and the printhead 80 is variably adjustable.

The printhead 80 rotates about the shaft 82, to one end of which is affixed the arm 84. Accordingly, clockwise movements of the arm 84 about the shaft 82 cause the printhead 80 to move toward the platen roller 46. If the printhead 80 is moved so that it is engaged against a print medium passing between the platen roller 46 and the printhead 80, further clockwise movements of the arm 84 about the shaft 82 will cause the pressure of the printhead 80 against the print medium to increase.

Movements of the arm 84 are controlled by the rack and pinion mechanism including the rack 86 and the pinion gear 88. The pinion gear 88 is attached to the shaft 90, which is driven by the stepper motor 92. A cam 94 is attached to the end of the shaft 90.

The rack 86 is formed on a carrier 96 which includes a first cavity 98 and a second cavity 100. The first cavity 98 and the second cavity 100 are separated by a wall 102. A container 104, adapted to receive the end of the arm 84, is placed in the second cavity 100, adjacent to the wall 102. A wire form 106, impinging on the right-hand wall of the container 104 and then passing to the left through a lower portion of the container 104, through a hole in the wall 102, into the first cavity 98, exerts a leftward force against the arm 84 through the action of the spring 108 on the portion of the wire form 106 in the first cavity 98 between the wall 102 and the end 110 of the wire form 106. If the stepper motor 92 is activated to cause the pinion gear 88 to rotate in a counterclockwise direction, the carrier 96 receives a leftward force through the action of the wall 102 against the wire form 106 by virtue of the spring 108 placed around the wire form 106 and the first cavity 98. This leftward force causes the wire form 106 to bear with increasing force in a leftward direction against the container 104 in the second cavity 100. This, in turn, increases the leftward force against the arm 84, creating a clockwise torque on the shaft 82. This torque increases the pressure of the printhead 80 on the print medium passing between the printhead 80 and the platen roller 46. Continuing counterclockwise operation of the stepper motor 92 further compresses the spring 108, thereby variably increasing the pressure of the printhead 80 against any print medium between the printhead 80 and the platen roller 46.

Also attached to the bottom of the carrier 96 is a projection 112 which passes between the two opposing faces of an optical caliper detector 114, which is held fixed with respect to the motor drive module frame 37. If the stepper motor 92 causes the carrier 96 to slew to the right, the projection 112 will pass between the two halves of the optical caliper detector 114, breaking a light beam which passes from one half of the optical caliper detector 114 to the other half of the optical caliper detector 114. Breaking the light beam causes the optical caliper detector 114 to produce an electrical signal indicating that the carrier has reached a "home" position in which the printhead 80 is moved away from the platen roller 46 by a predetermined repeatable distance. As the carrier 96 moves to the left from the home position, the number of pulses provided to the stepper motor increases from 0, the count at the home position. Therefore, it is possible to apply a highly repeatable pressure of the printhead 80 against the print medium passing over the platen roller 46.

The cam 94 on the end of the shaft 90 engages one end of a leaf spring 116. The other end of the leaf spring 116 is attached to a pivot arm 118, which, in turn, is fixed to the end of the pivot shaft 74. Accordingly, as the cam 94 actuates the leaf spring 116, pivot shaft 76 rotates in a clockwise direction, causing the idler roller 72 to be forced toward the pinch roller 70, capturing the print medium passing therebetween.

In FIG. 2, the carrier 96 of the rack and pinion printhead pressure mechanism has been moved to the left of the home position by a counterclockwise rotation of the stepper motor 92, which causes the cam 94 to enter the detent in the leaf spring 116 and moves an idler roller 72 away from the pinch roller 70. In the print mode, the print medium is advanced through the print medium path 38 by the force of the platen roller 46 against the print medium due to the pressure applied against the print medium by the printhead 80.

Figure 3:
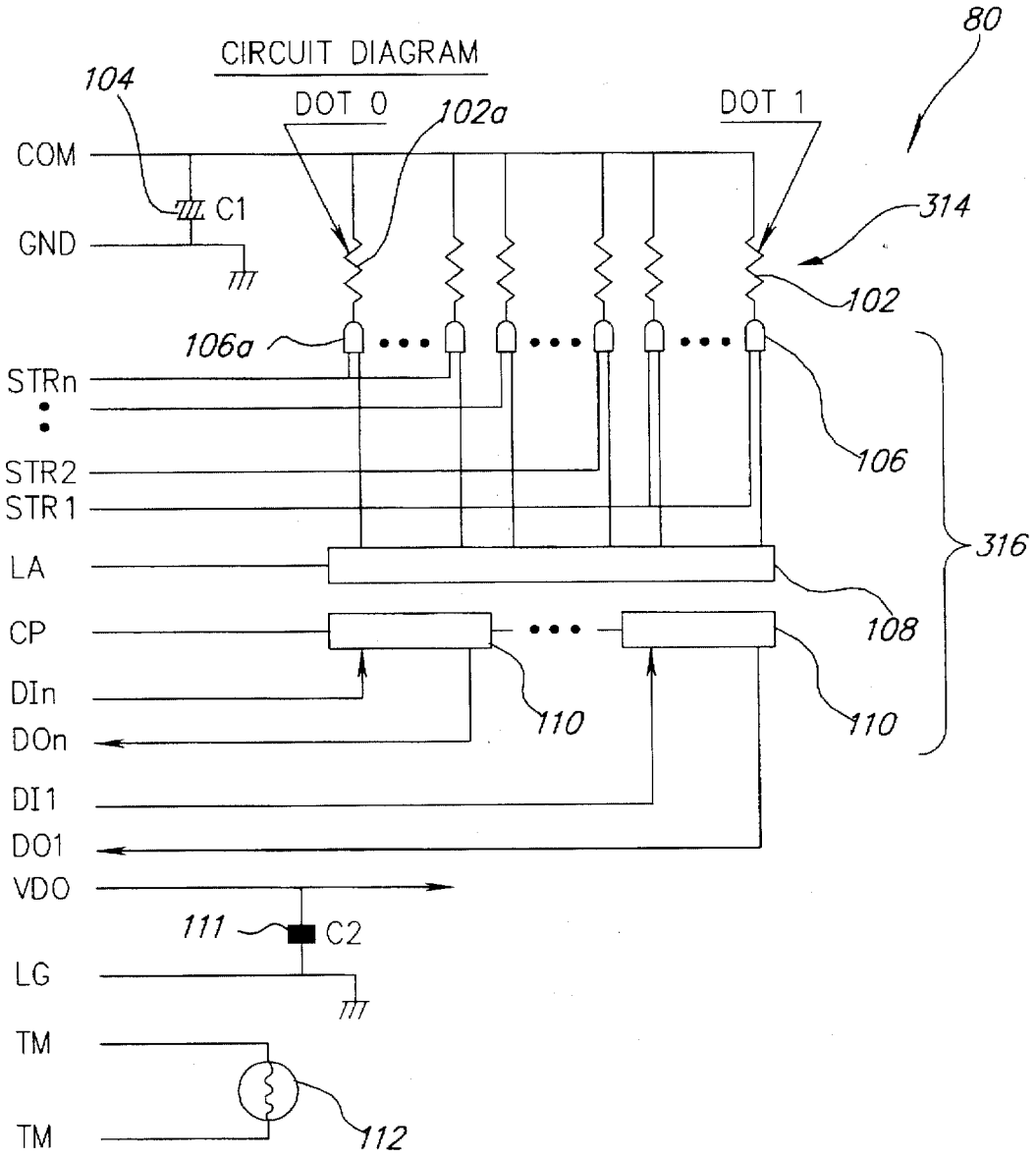
FIG. 3 is an electrical schematic of a printhead in a thermal printer.

FIG. 3 is an electrical schematic of a printhead in a thermal printer. The printhead 80 comprises a linear array of small, closely spaced resistive thermal print elements $\mathbf{102}_1$–$\mathbf{102}_a$. The plurality of thermal print elements 102 make up the print bead 314 shown in FIGS. 6A–6D. A first end of each of the resistive thermal print elements $\mathbf{102}_i$ is connected to an common electrode which is connected to a power supply electrode to maintain the common electrode 344 at a voltage above ground. A capacitor 104 may be used to hold the voltage generally constant. Preferably, capacitor 104 is a 10 MF, 50 volt capacitor, but capacitors of other values may be used or, alternatively, no capacitor is present and the voltage at the first end of the thermal print element $\mathbf{102}_i$ varies. The other end of each of the resistive thermal print elements $\mathbf{102}_i$ is connected to an AND gate $\mathbf{106}_i$. Each of the AND gates $\mathbf{106}_i$ receives two signals. One of the signals is a strobe signal and the other is a data signal transferred from a latch 108. The data signal is thus used to select one or more of the thermal print elements 102. When the thermal print element $\mathbf{102}_i$ is selected, a second end of the resistive thermal print element $\mathbf{102}_i$ is connected to ground.

The first end of each of the resistive thermal print elements 102 is connected to a common electrode which is held at a high voltage above ground so that when the second end of the thermal print elements 102 is connected to ground, a current passes from the common electrode, through the select thermal print element $\mathbf{102}_i$and then through the ground electrode to ground. This creates a direct current path from the positive power supply to which the common electrode is connected to ground creating a high current flow through the selected thermal print element $\mathbf{102}_i$. The current flowing through the selected thermal print element $\mathbf{102}_i$ causes the thermal print element $\mathbf{102}_i$ to rapidly heat to a relatively high temperature and to perform thermal printing in a manner which is well-known in the art. The details of how thermal printing per se are carried out are well-known in the art and a number of publications can be referred to for a detailed description of thermal printing using a plurality of resistive thermal print elements.

After the desired signal has been sent to the selected thermal print element $\mathbf{102}_i$, the thermal print element $\mathbf{102}_i$ is turned off by unselecting the thermal print element $\mathbf{102}_i$. This causes the high value current to cease to flow through the thermal print element $\mathbf{102}_i$, permitting it to rapidly cool off and return to the status of a non-selected thermal print element.

In one particular preferred embodiment, the resistive thermal print elements $\mathbf{102}_i$ can be grouped into a number of adjacent groups of thermal print elements, each group occupying a particular region of the thermal printhead 80. This allows each group of thermal print elements 102 to receive an independently generated strobe signal, which can differ from the strobe signals transmitted to the other groups of thermal print elements 102. For example, if the printhead 80 includes 896 thermal print elements $\mathbf{102}_i$, it can be divided into four independently-drive regions, the first region including 128 thermal print elements $\mathbf{102}_i$ and the remaining three regions each including 256 thermal print elements. However, in another preferred embodiment, the same strobe signal is transmitted to each AND gate $\mathbf{106}_i$. The signals representing the data contained in the latch 108 are imposed on one leg of each corresponding AND gate $\mathbf{106}_i$, beginning at a time specified by the latch (LA) signal. This arrangement permits each of the AND gates $\mathbf{106}_i$ to receive its corresponding data at the same time as all of the other AND gates $\mathbf{106}_i$.

The data stored in the latch 108 are transferred from a number of shift registers $\mathbf{110}_1$–$\mathbf{110}_n$. The number of shift registers $\mathbf{110}_i$ corresponds to the groups of thermal print elements discussed previously. Therefore, in the first preferred embodiment discussed above, n=4. Each of the shift registers $\mathbf{110}_i$ receives data from a separate input data line (DIi). The data are shifted into the consecutive stages of the shift register $\mathbf{110}_1$ at times governed by the clock pulse (CP) signal. If desired, the data in each shift register $\mathbf{110}_i$ can be cycled out on the data out line (DOi). The voltage on the logic elements of the printhead 80 (i.e., the latch 108 and the shift registers $\mathbf{110}_i$) is maintained by the capacitor 111. The printhead 80 also includes a thermistor 112 which produces a signal indicative of the temperature of the printhead 80. The circuits of 106, 108 and 110, etc. constitute the print head selection control circuitry shown in block form as element 316 in FIGS. 6B–6D.

Figure 4A:
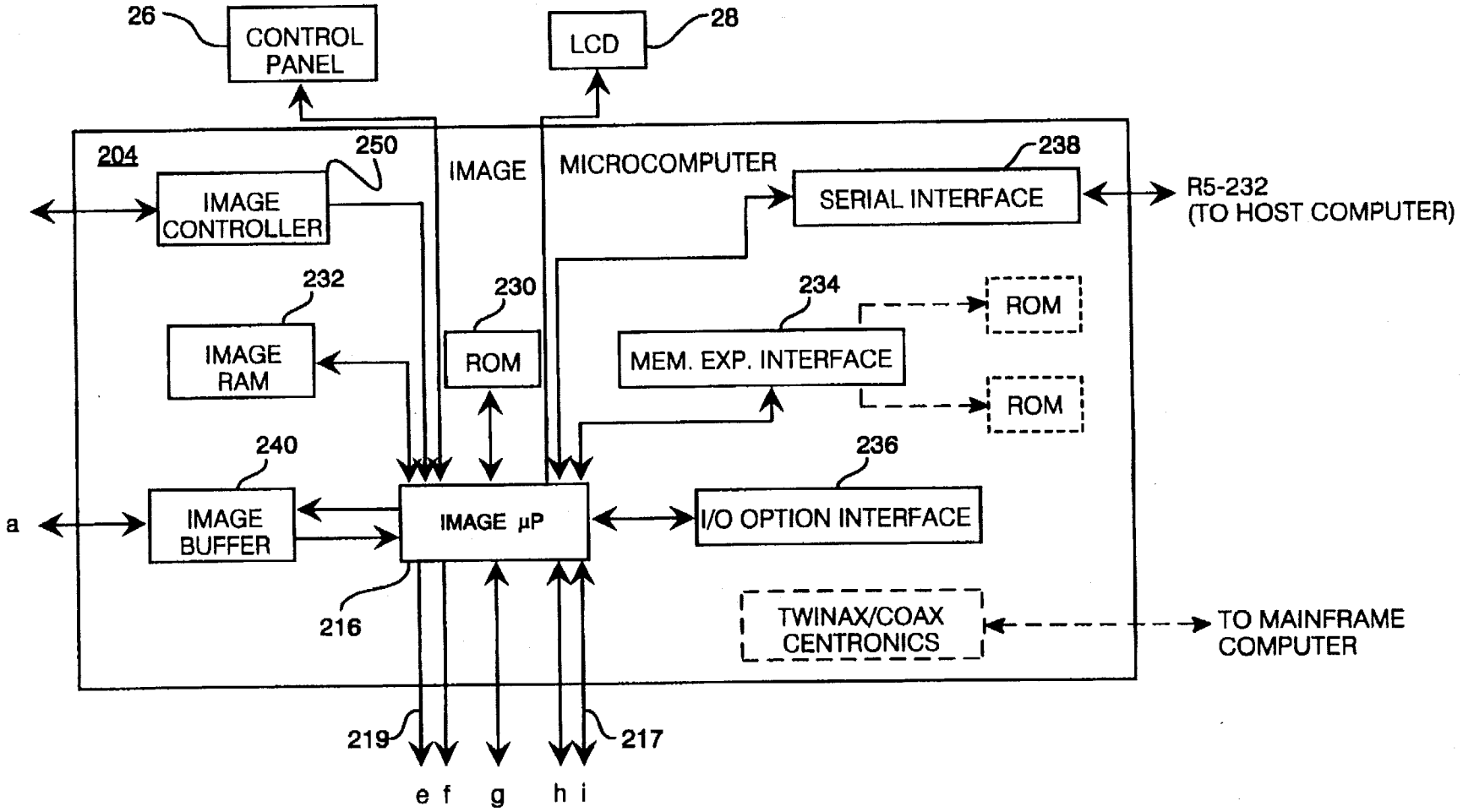
FIG. 4A is a first portion of an electrical schematic diagram of a thermal printer according to the preferred embodiment.
Figure 4B:
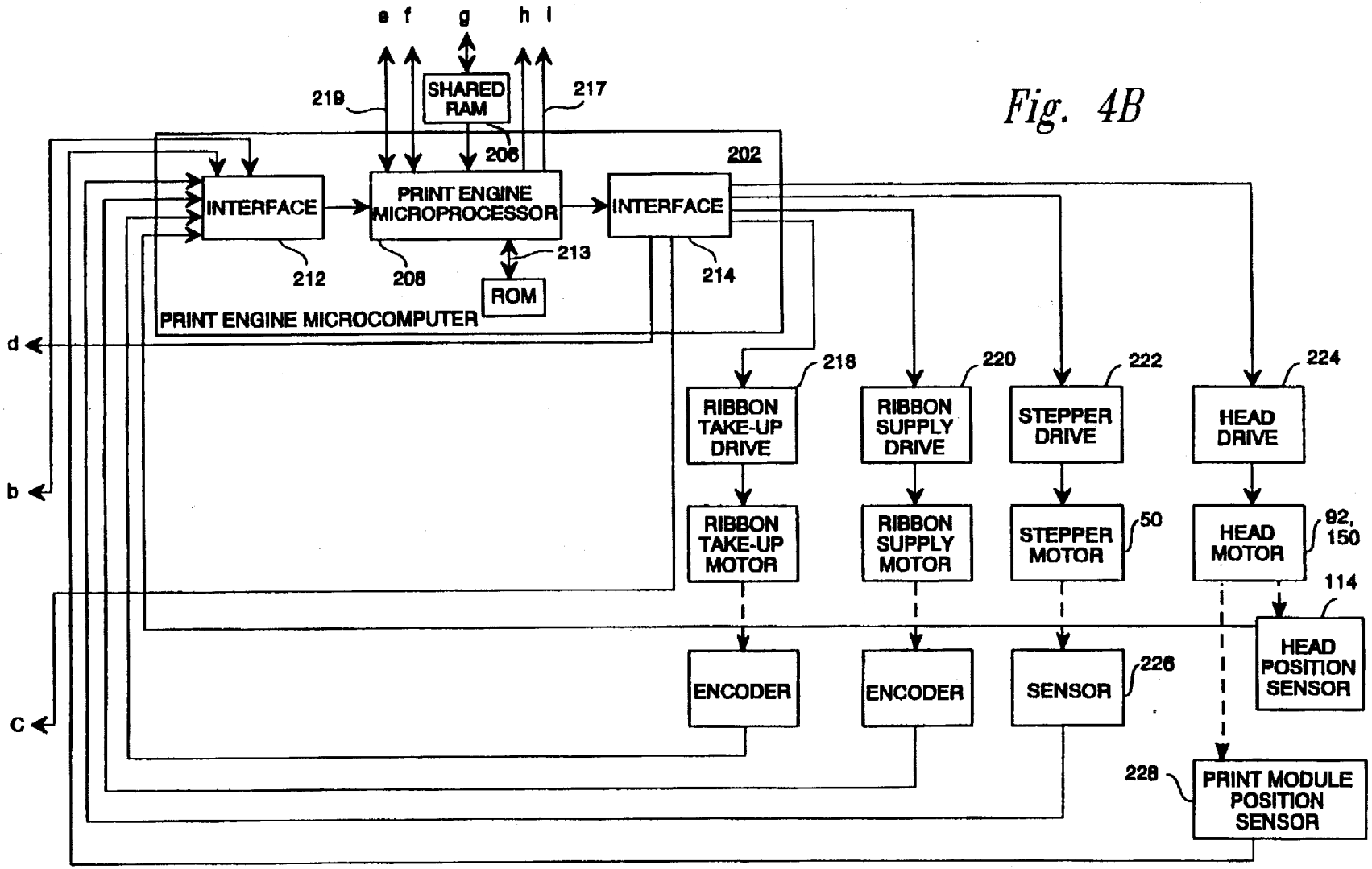
FIG. 4B is a second portion of an electrical schematic diagram of a thermal printer according to the preferred embodiment.
Figure 4C:
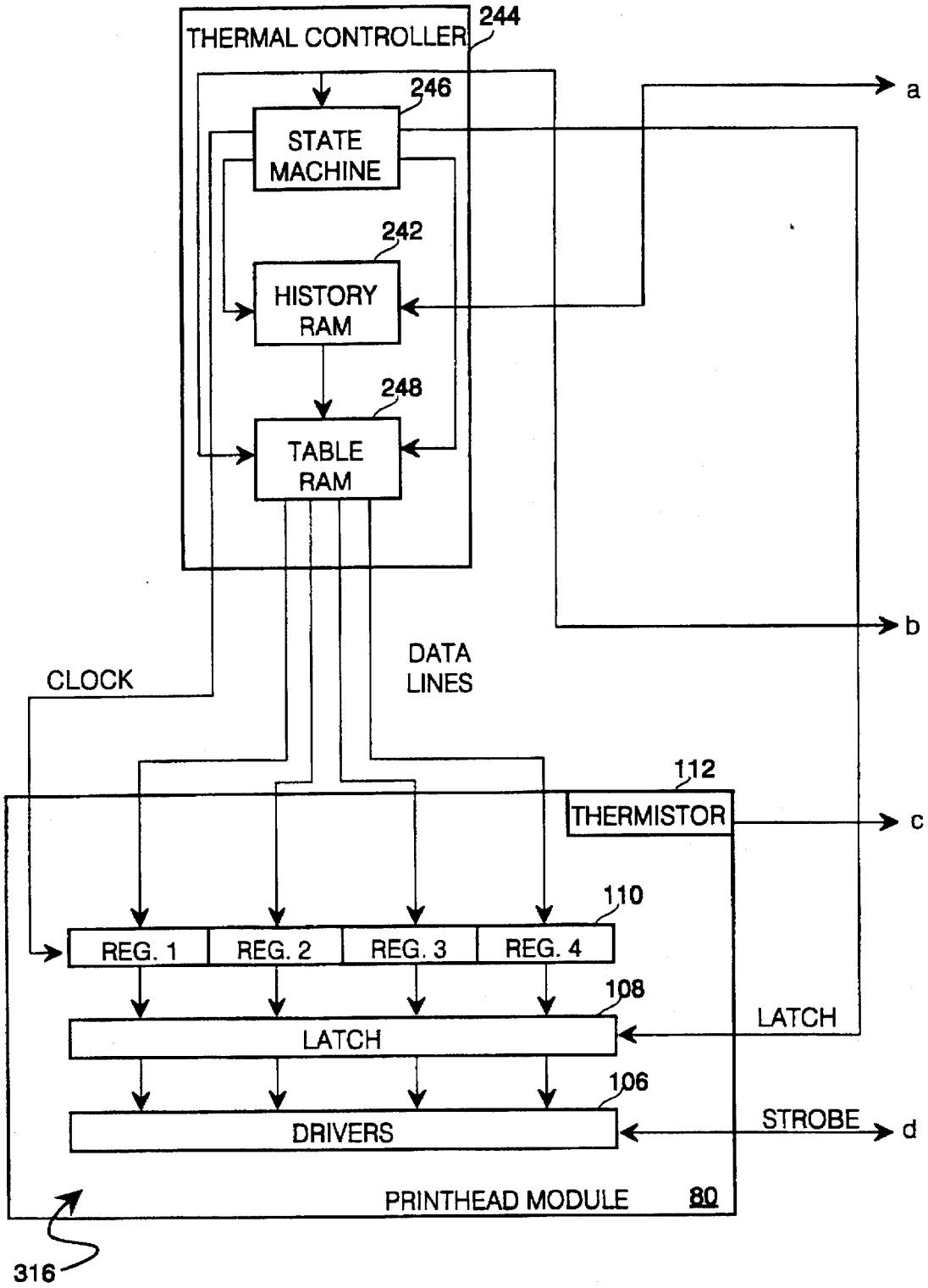
FIG. 4C is a third portion of an electrical schematic diagram of a thermal printer according to the preferred embodiment.

FIG. 4 is an electronics schematic diagram. The electronics includes two microcomputers, a print engine microcomputer 202 and an image microcomputer 204. The print engine microcomputer 202 is primarily responsible for controlling the movement of the print medium and the thermal transfer ribbon (if any) through the printer path and supplying print timing commands to the printhead 80. The image microcomputer 204 produces the images which are to be printed on the print medium. The print engine microcomputer 202 includes a print engine microprocessor 208, a read-only memory (ROM) 210, an input interface 212, and an output interface 214. The ROM 210 communicates with the print engine microprocessor 208 over bidirectional lines. The input interface 212 transmits signals to the print engine microprocessor 208 and the print engine microprocessor 208 transmits signals to the output interface 214.

The image microcomputer 204 includes an image microprocessor 216. The print engine microprocessor 208 and the image microprocessor 216 both communicate over bidirectional lines with a shared random access memory 206. In addition, the print engine microprocessor 208 can communicate interrupt signals to the image microprocessor 216 and the image microprocessor 216 can communicate interrupt signals to the print engine microprocessor 208.

Through the output interface 214, the print engine microprocessor 208 sends the signals to a ribbon take-up drive 218, a ribbon supply drive 220, a stepper motor drive 222, and a head motor drive 224. The stepper motor drive 222 produces appropriate drive signals and transmits them to the stepper motor 50. The head motor drive 224 also produces appropriate signals and sends them to the head motor 150. Movements of the print medium caused by the stepper motor 50 are sensed by the sensor 226 which produces signals that are transmitted to the input interface 212. Movements of the printhead 80 by the head motor 150 are monitored by two sensors, the optical caliper detector 114 and a print module position sensor 228. The optical caliper detector 114 transmits signals to the input interface 212, indicating whether the printhead 80 is in the print mode or the idle mode. The print module position sensor 228 transmits a signal which indicates whether the printer module 34 is disengaged from the motor drive module 36. .

The ribbon take-up and ribbon supply drives operate similarly to one another. Each of them receives signals from the output interface 214 and produces signals which drive the ribbon take-up and supply motors, respectively. Under command from the print engine microprocessor they facilitate movements of the thermal transfer ribbon in the print module 34, if a thermal transfer medium is being used. The two ribbon motors are monitored by encoders which send signals to the input interface 212. These signals can be used by the print engine microprocessor 208 in case of a ribbon jam or break. The ribbon take-up and supply drives also operate to balance the torques in their two respective rolls, so that the ribbon moves smoothly, at the same speed as the print medium, without wrinkling or breaking. In addition, in case the print engine microprocessor 208 declares a print save mode, the two ribbon drives bring the ribbon to a halt, which is signified to the print engine microprocessor 208 by the respective encoders.

The image microprocessor 216 also shares information with the ROM 230 and an image RAM 232 on a bidirectional line. The ROM 230 contains programs and used by the image microprocessor 216 and data describing invariant signals, such as the selection of strobe signals which may be used by the print engine microprocessor in a method to be described subsequently. The image RAM 232 contains a number of bands of the image to be printed. In addition, the image microprocessor 216 drives the LCD 28 and communicates with the control panel 26 over a bidirectional line. Further, the image microprocessor 216 communicates over a bidirectional line with the memory expansion interface 234, which has provisions for adding more RAM and ROM to the image microcomputer I/O 204. The image microprocessor 216 also communicates with the I/O option interface 236 over a bidirectional line. The interface 236 allows communications between the image microprocessor 216 and a mainframe computer. This data link can be used to load data to a mainframe computer for further processing, or to load data from a mainframe computer to the image microprocessor 216, such as data for the image RAM 232. Beyond these communication links, the image microprocessor 216 can also communicate with a serial interface 238 over a bidirectional line. This link will also allow the transfer of data in and out of the image microprocessor 216, but will also allow the image microprocessor 216 to be reprogrammed. Finally, the image microprocessor 216 also communicates with an image buffer 240 over a unidirectional bus and receives an interrupt signal from the image buffer 240 over a unidirectional line. The image buffer transfers images the image microprocessor 216 has retrieved from the image RAM 232 to a history RAM 242 in a thermal controller 244. The thermal controller, which produces the signals used to define the thermal images to be printed by the printhead 80, also includes a state machine 246 and a table RAM 248. The state machine 246 produces timing signals needed by the thermal controller 244, under the influence of signals produced by the output interface 214, which is connected to the print engine microprocessor 208. The table RAM 248 is loaded with a table from the ROM 210 in the print engine microcomputer 202 by the print engine microprocessor 208 through the output interface 214. The table RAM 248 receives timing signals from the state machine 246 and the history RAM 242. These signals point to a particular entry in the table RAM 248, depending upon the history of the current thermal print element as designated by the image sent by the image buffer 240 to history RAM 242. The data produced from the table RAM 248 are sent over data lines to the data registers $110_i$ in the printhead 80 to cause a thermal printing of the proper image in a manner generally known in the art and described herein. The thermal controller also produces the clock signal which provides proper timing to the registers $110_i$. The latch and strobe signals are respectively sent to the latch 108 and drivers $106_i$ by the output interface 214, which receives its input from the print engine microprocessor 208, as described previously. The latch signal is produced by the state machine 246.

The image microcomputer 204 also includes an image control 250 which receives the voltages COM and GND from the printhead 80. The image controller 250 uses the sensed voltage difference to ensure that the image quality is acceptable. There are numerous techniques for ensuring the quality of the image, one is to maintain the difference between the two voltages COM and GND at a desired level. Another technique is to vary the print time so that the print element stays on longer if the voltage difference is lower. The implementation of these two techniques to maintain the print quality, as well as others, and the circuits to perform this image control are generally known in the art and any suitable control technique is acceptable in the context of this invention, if the correct voltage is properly sensed as taught by this invention.

Figure 5:
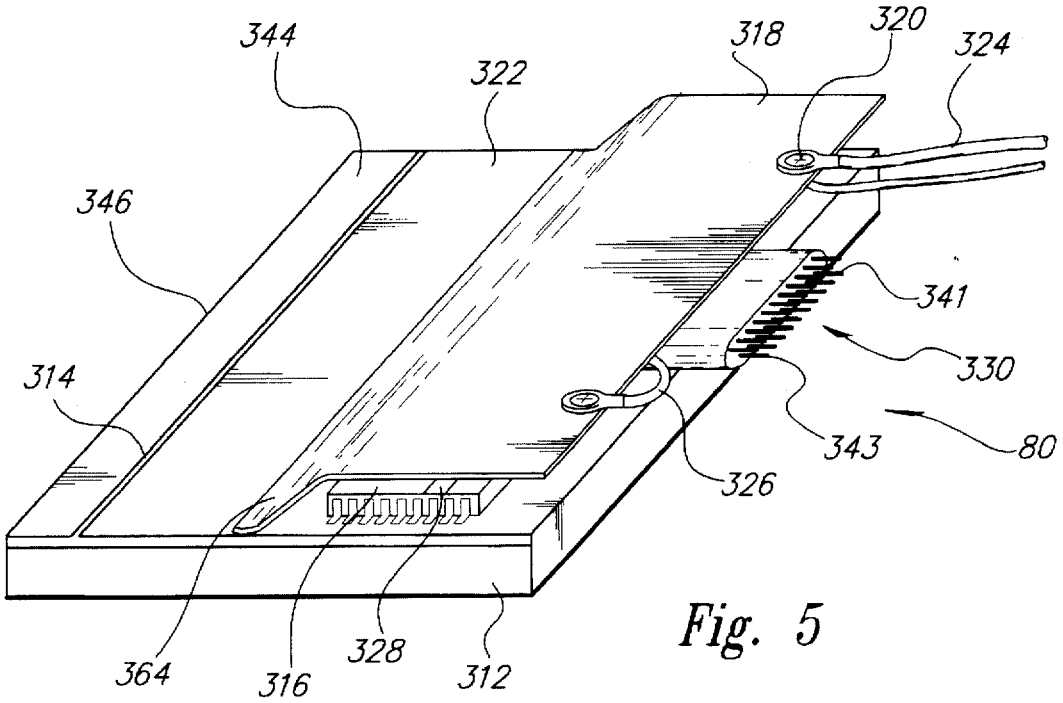
FIG. 5 is an isometric view of the thermal printhead of the present invention.

FIG. 5 is an isometric view of the thermal printhead of the present invention. The printhead 80 is built on a substrate 312, preferably, but not necessarily, made from a ceramic material and consisting primarily of a print bead 314, associated electronic driver circuitry 316, and an electrically conductive printhead driver cover 318. Driver cover 318 is spring loaded in reaction to the forces imposed by retaining screws 320 to maintain electrical contact with upper surface 322. Cover 318 is connected to electrical ground ("GND")

through grounding conductor 324. Electrical conductor 326 connects grounded cover 318 to points in electronic driver circuitry 316 that should be grounded. In particular, grounding strap 328 is grounded through electrical conductor 326.

Figure 6A:
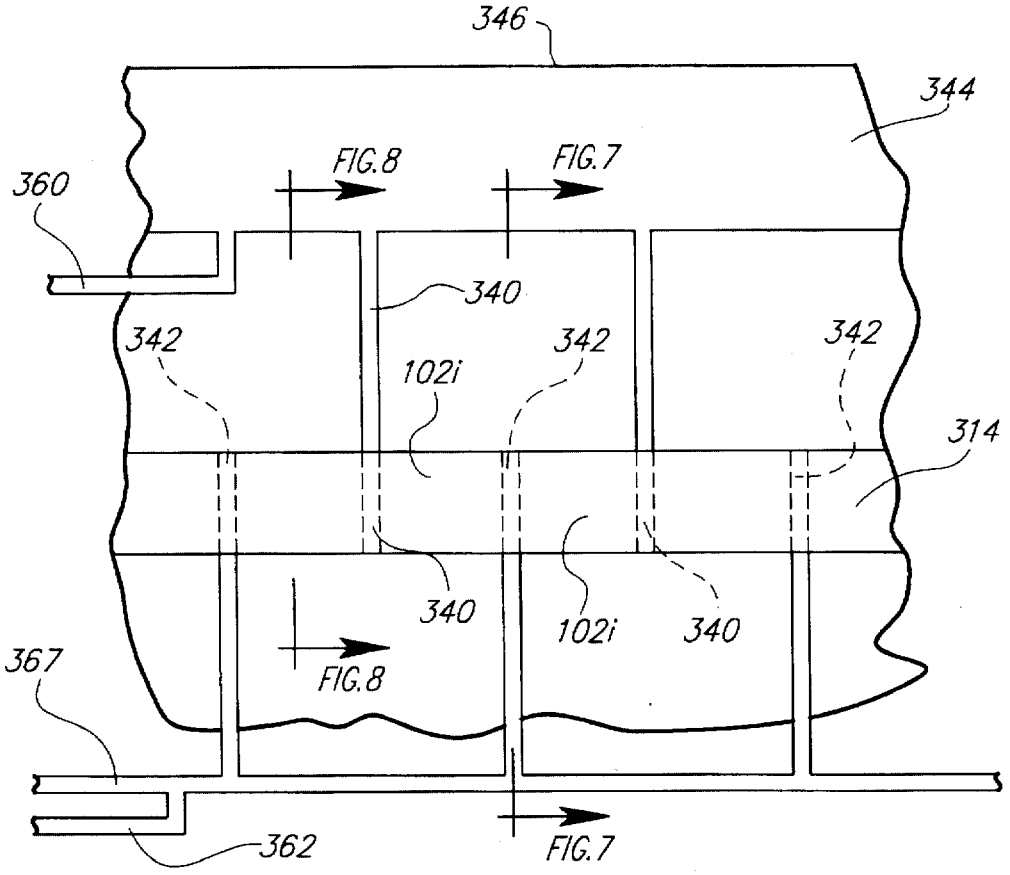
FIG. 6A is an enlarged plan view of the various electrodes and some thermal print elements of the thermal printhead of FIG. 5.
Figure 6B:
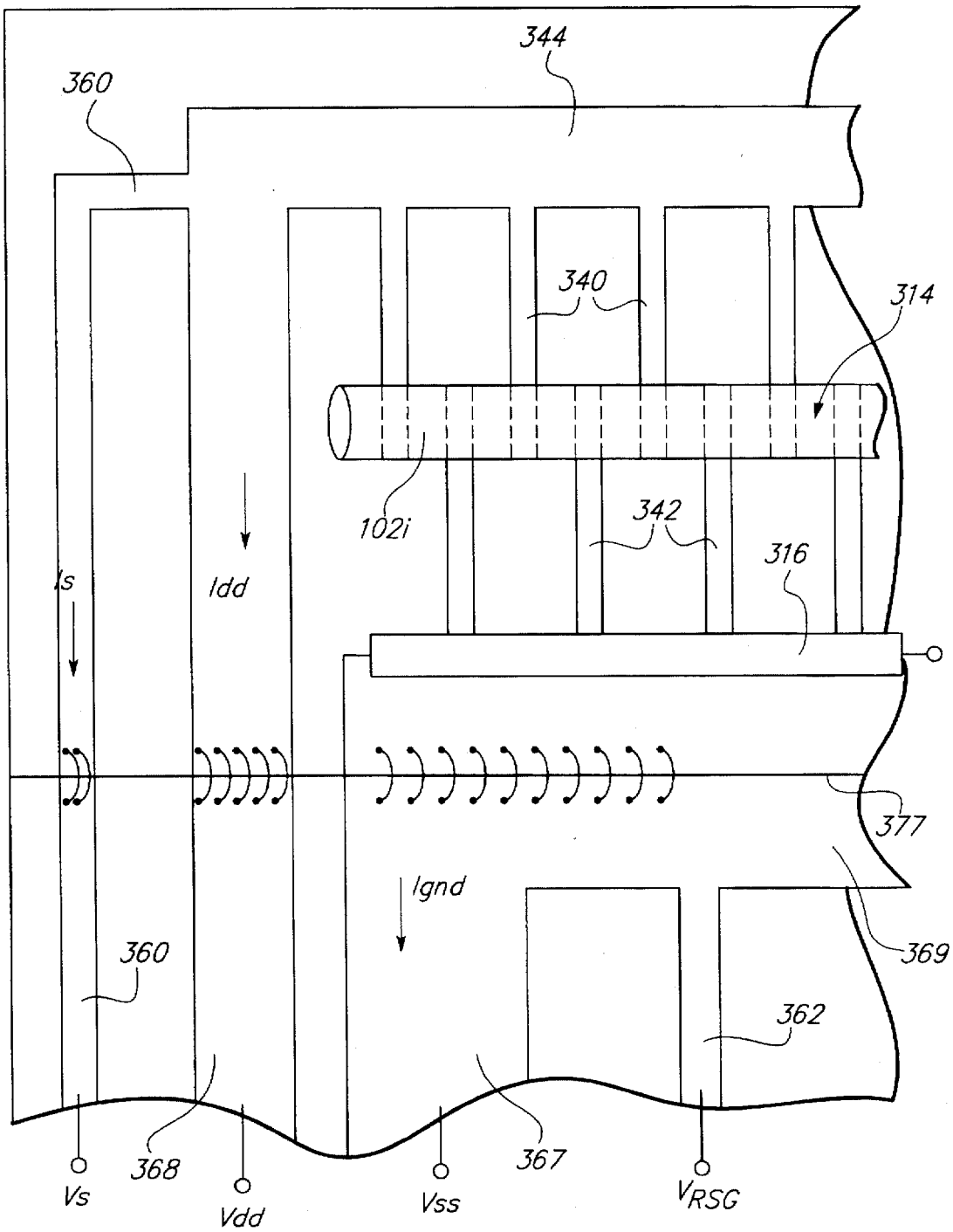
FIG. 6B is an enlarged plan view of an alternative embodiment of the various electrodes and some thermal print elements of the thermal printhead of FIG. 5.
Figure 6C:
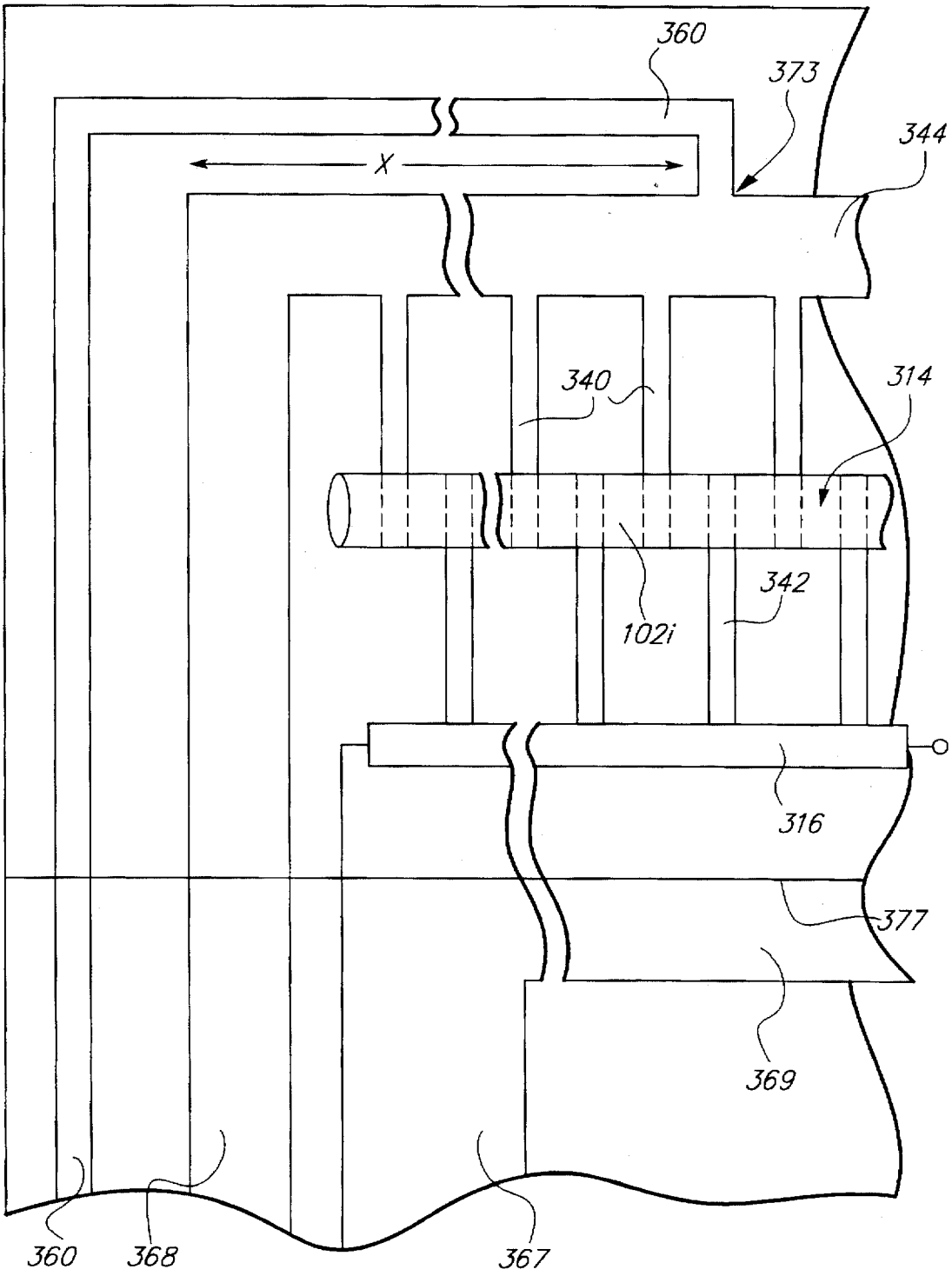
FIG. 6C is an enlarged plan view of a further alternative embodiment of the various electrodes and some thermal print elements of the thermal printhead of FIG. 5.

In most thermal printheads, the thermal print element will be on a substrate with the common electrode 344 and at least portions of the first conductor 368, the second conductor 367 and the remote sense electrode 360 as shown in FIGS. 6B and 6C. Preferably, the first conductor 368, second conductor 367 and remote sense electrode 360 are constructed of gold plating or other highly conductive material, such as copper, silver, aluminum and the like. The substrate on which the thermal printhead is positioned is then electrically connected via the a flex circuit 377. The flex circuit 377 connects the first conductor 368, the second conductor 367, and the remote sense electrode 360 to their respective connector pins 330. The flex circuit 377 is shown as a wire connection in FIG. 6B and as a press fit connection in FIGS. 6C, these being two acceptable techniques that are presently well known in the art for connecting the printhead substrate to the connector pins 330.

The COM connection, the data line connections, and circuit ground high voltage connections are made through the connector 330. In one embodiment, two connectors 330 are provided, one for logic and one for power to avoid cross-talk between the two.

The electronic driver circuitry 316 is connected to shift serially received data across the linear array of drivers that control thermal print elements 102i created along a print bead 314. In one embodiment, print bead 314 can be electronically driven to create 416 individual dots, each dot extending 9.84 thousandths of an inch in the direction along print bead 314. Therefore, the thermal printer of which printhead 80 is a part can create straight lines up to approximately 4.1 inch in length.

After the data have been serially loaded into the individual print element drivers through electrical connector 330, the circuitry receives a strobe pulse which causes the individual thermal print elements $\mathbf{102}_i$ to be heated or not be heated by a heating current, depending upon whether a 1 or a 0 has been loaded into the corresponding driver.

Print bead 314 creates transverse lines on the temperature-sensitive media as the media passes, in intimate contact with print bead 314, from right to left over printhead 80. The printing medium is incrementally driven by the stepper motor 50, the increments being substantially equal to the width of the line created by print bead 314. This allows solid characters to be created by printhead 80.

FIG. 5 is not intended to show the details of the electrical traces and conductors because they would appear quite small in this view, the enlarged views of FIGS. 6A–6D are provided to show the conductive strips on the printhead.

FIG. 6A is a closeup plan view of the vicinity of print bead 314 of thermal printhead 80. Print bead 314 is a continuous linear bump that rises above the general level of upper surface 322 of printhead 80. Print bead 314 is defined by the deposition of a thin, linear strip of resistive material which heats when it receives electrical current. The structure of print bead 314 will be shown in greater detail subsequently. Print bead 314 lies over and comes into contact with one or more first conductive leads 340 and one or more second conductive leads 342 forming one or more thermal print elements $\mathbf{102}_i$. The first conductive lead 340 is connected to a first end of the resistive thermal print element $\mathbf{102}_i$. The second conductive lead is connected to a second end of the resistive thermal print element $\mathbf{102}_i$. First and second conductive leads 340 and 342 are uniformly interdigitated under print bead 314 with a center-to-center spacing of approximately 4.92 mils, the width of the conductive leads 340 and 342 themselves being substantially smaller than the center-to-center spacing. First conductive leads 340, which can serve as anode leads, are held at a predetermined high supply voltage through their connection to conductor 344, upon which supply voltage is imposed. The conductor 344 is often referred to as the common electrode in the art because the first end of all the thermal print elements 102 are all connected to the same voltage potential, usually of a higher value, such as 12 volts or 24 volts. Second conductive leads 342 can be selectively grounded or not selectively grounded through the electronic driver circuitry 316. If a particular second conductive lead, which may be a cathode lead, is grounded, a conductive path is completed between the grounded second conductive lead 342 and the two adjacent first conductive leads 340, permitting the passage of electric current between them through thermal print element $\mathbf{102}_i$ on print bead 314. The resulting conducted current causes the local position of print bead 314 surrounding the grounded second conductive lead 342 to heat, thereby creating a small rectangular dot whose transverse extent equals the center-to-center separation between first conductive leads 340. If, on the other hand, a second conductive lead 342 is not grounded, the local area surrounding the second conductive lead 342 will not heat and a black dot will not be created thereby.

In the current implementation, the electrical resistance of a single linear print element is approximately 250 ohms. When appropriately grounded through a second conductive lead 342, a typical print element experiences a temperature rise of approximately 300 degrees C. above its ambient temperature of 50 degrees C. in less than two milliseconds, the period of time for which a second conductive lead 342 is grounded. When second conductive lead 342 is disconnected from ground, the print element returns to ambient temperature.

Figure 7:
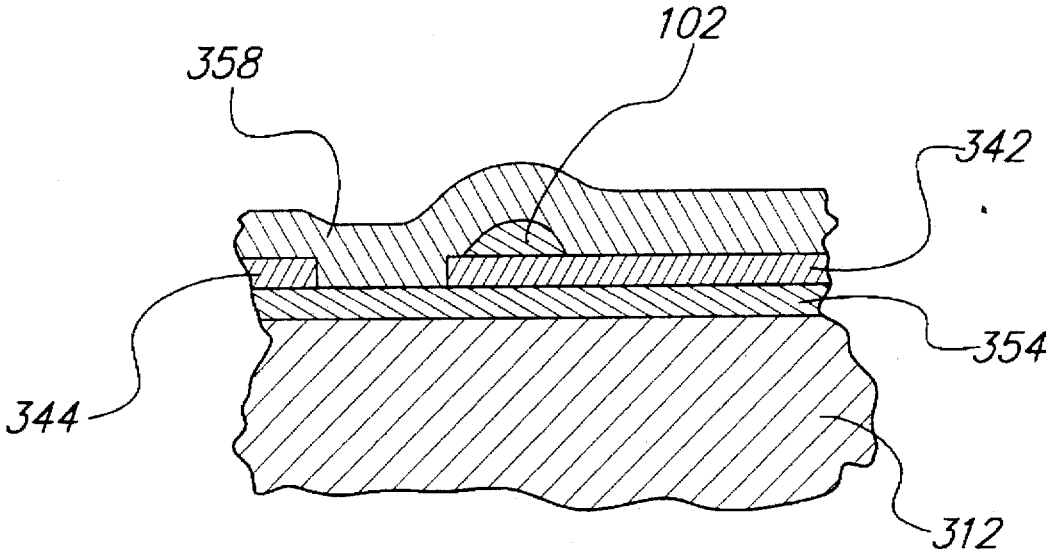
Fig. 7 (Prior Art)
FIG. 7 is an enlarged fragmentary cross-sectional view of the print head of FIG. 6A, taken along section 7—7.

FIG. 7 is a fragmentary cross-sectional view of the printhead of FIG. 6A, taken along section 7—7. The structure in the vicinity of print bead 314 is created over substrate 312. Glass underglaze 354 is formed over substrate 312 and serves to thermally insulate substrate 312 from the layers formed over glass underglaze 354 at least in those areas where such insulation is desired. Along section 7—7 of FIG. 6A, a portion of glass underglaze 354 is covered by second conductor lead 342, which extends under and makes electrical contact with the semicircular form of thermal print elements 102. Another portion of glass underglaze 354 is overlaid by a glass overglaze 358. Depending upon the manufacturing tolerances in the placement of thermal print element 102 with respect to the end of second conductive lead 342, thermal print element 102 can either contact glass underglaze 354 or lie entirely over second conductive lead 342. Glass overglaze 358 covers the thermal print element 102 and at least a portion of second conductor lead 342 in the vicinity of the electrical connection between second conductive lead 342 and thermal print element 102. If desired, glass overglaze 358 can cover substantially all of second conductive lead 342.

Figure 8:
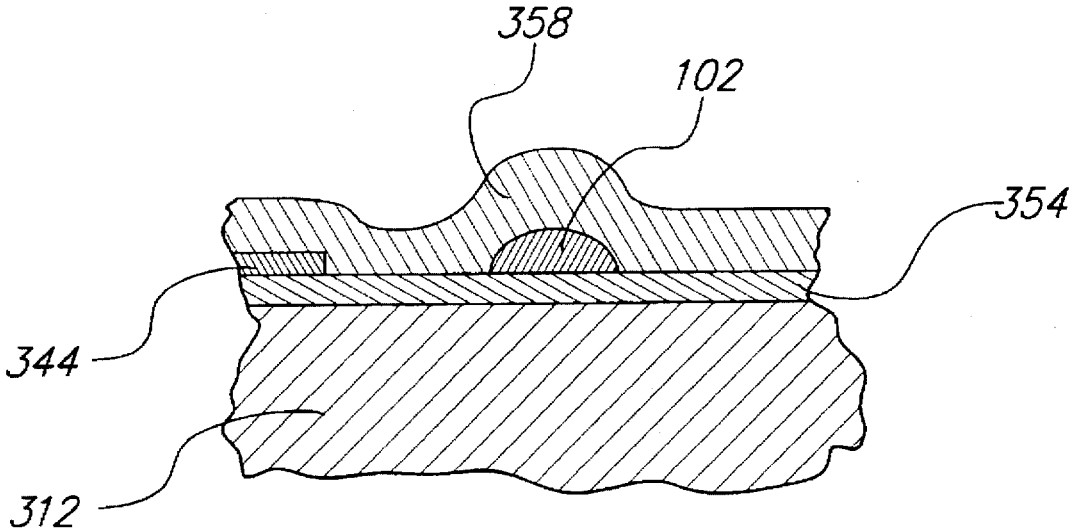
Fig. 8 (Prior Art)
FIG. 8 is an enlarged fragmentary cross-sectional view of the print head of FIG. 6A, taken along section 8—8.

FIG. 8 is a fragmentary cross-sectional view of the printhead of FIG. 6A, taken along section 8—8. The printhead is formed over substrate 312 and extends to edge 346 of printhead 80 (see FIG. 5). Glass underglaze 354 is formed over the surface of substrate 312. Conductor 344, which is typically made from gold, silver, aluminum, or their alloys, extends from edge 346 back toward thermal print element 102 of print bead 314 and overlapping glass underglaze 354. Along section 8—8 of FIG. 6A, there are no conductor leads making contact with thermal print element 102. Therefore, after thermal print element 102 has been formed on glass underglaze 354, and at least some surrounding portions of glass underglaze 358.

The thermal printhead structure described in connection with FIGS. 7 and 8 is a typical thermal printhead structure known in the prior art. Such a printhead can be purchased from the Rohm Company. Other specific forms of thermal printheads are also available using a thermally conductive, electrically insulative overglaze.

A novel aspect of the printhead of the invention is that it includes at least one remote sense electrode 360 formed to connect to pin 341 on connector 330 (see FIG. 5) and that it optionally further includes at least one remote ground sense electrode 362 formed to connect to a ground electrode pin 343 on connector 330. The voltages sensed by the remote sense electrodes 360 (and optionally remote ground sense electrodes 362) are connected to a circuit which monitors the difference voltage between the two voltages and compensates for incipient changes to ensure that the printhead 80 produces high quality print. One method of compensation is to maintain this difference at an acceptably substantially fixed value; another method is to vary the print element heating schedule to compensate for changes in heating rate as previously discussed herein. If the difference voltage were monitored by the circuit via power supply electrodes which carry a high current and a widely varying current, the difference voltage would not typically be maintained within the tolerances which have been determined to be necessary to ensure the desired high quality print.

A preferred method for sensing the voltage at a first end of the thermal print elements 102 is to apply power to a first plurality of the thermal print elements 102 through a heating current carried by the first electrical conductor 368. The first plurality of thermal print elements 102 are heated by maintaining the heating current for sufficient time to reach a desired temperature. The voltage potential of the common electrode 344 is sensed at a position in proximity to the location of the first ends of the thermal print elements 102 through the remote sense electrode 360. The remote sense electrode 360 is different than the first electrical conductor 368 which carries the heating current.

Power is then supplied to a second plurality of the thermal print elements 102 by means of a second heating current carried by the first electrical conductor 368. This second plurality of thermal print elements 102 is heated by maintaining the heating current for sufficient time to cause the thermal print elements 102 to heat to a desired temperature. The voltage is sensed at the common electrode 344 at a position in proximity to the first ends of the thermal print elements 102 by the remote sense electrode 360 to insure that the print quality of the first plurality of thermal print elements 102 is uniform with the print quality of the second plurality of thermal print elements 102.

One method of insuring uniform print quality is to increase the power applied to the second plurality of thermal print elements 102 over the power applied to the first plurality of thermal print elements when there is a significantly higher number of thermal print elements energized in the second plurality of thermal print elements 102. Another method is to increase the time that the power is applied to the second plurality of thermal print elements 102 over the time the power was applied to the first plurality of thermal print elements 102, if the voltage sensed at the remote sense electrode 360 indicates a significant decrease in voltage because a greater number of thermal print elements 102 are energized.

Figure 6D:
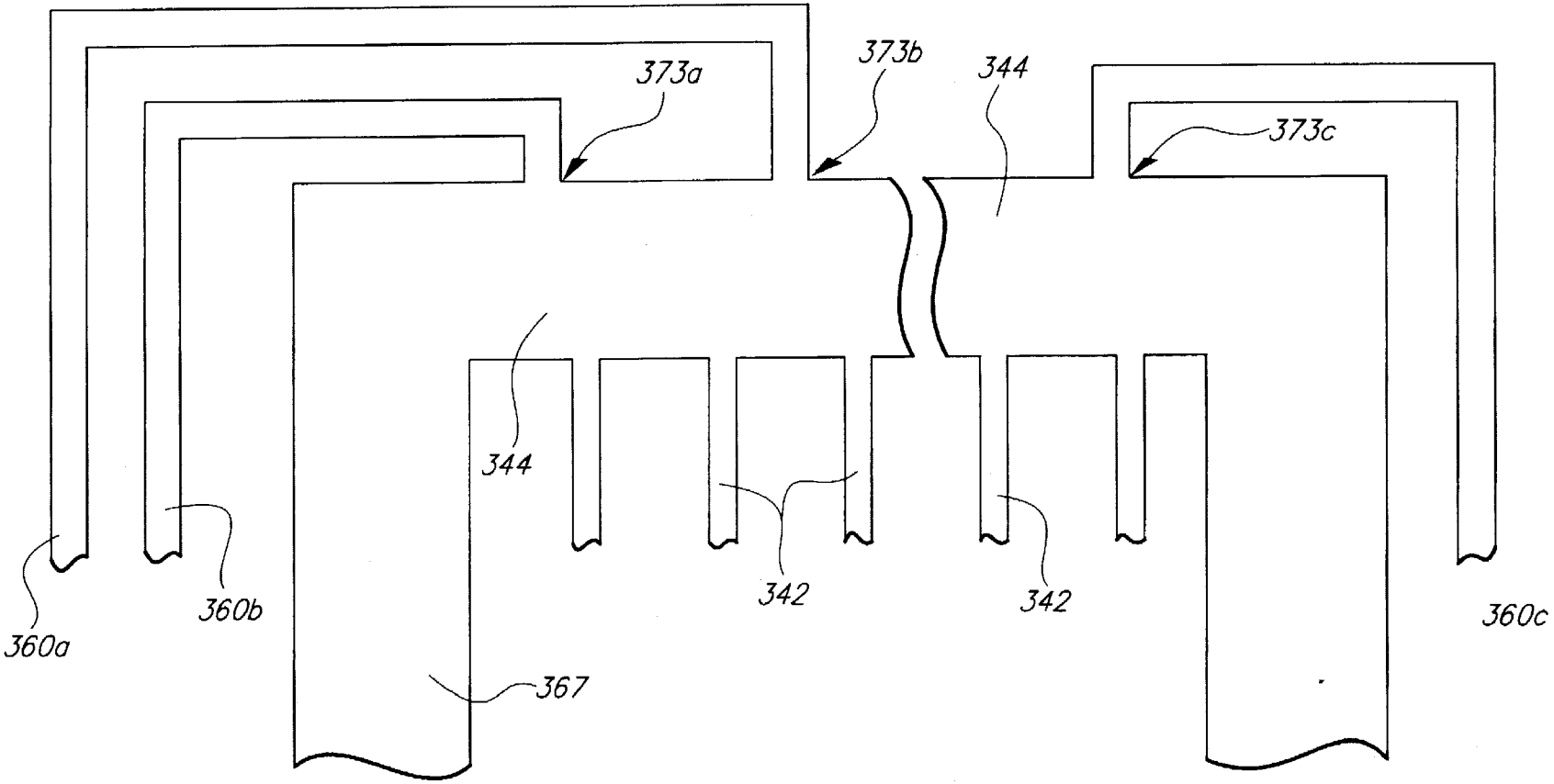
FIG. 6D is an enlarged plan view of a further alternative embodiment of the various electrodes and some thermal print elements of the thermal printhead of FIG. 5.

FIGS. 6B–6D illustrate further alternative embodiments of the invention. As illustrated in FIG. 6B, a print bead 314 includes a plurality of individual thermal print elements $102_i$ being contacted at their respective first ends via traces 340 and at their second ends via traces 342. The common electrode 344 is connected to the traces 340 to maintain the first end of the resistive thermal print elements $102_i$ at the common voltage, usually VDD or some other relatively high voltage. A first electrical conductor 368 is connected to the common electrode 344 to supply the electrical power current to heat the resistive thermal print elements 102 which comprise the bead 314.

The current travels through the common electrode 344, through the selected thermal print elements 102i and through the ground electrical conductor 367. The electronics 316 control the selection of the individual thermal print elements 102 as has been previously described herein.

During normal operation, the number of individual thermal print elements 102 which are turned on simultaneously will vary greatly. At some time during the printing procedure, a large number of the thermal print elements 102 will be turned on and a large current will be drawn along the electrical conductor 368 providing the heating power current. At other times during operation, and little to no current will be drawn along conductor 368. This results in the current being drawn along electrode 368 varying greatly over a wide range of values, from approximately a high maximum value to zero. In some embodiments, the high value can be in the range of 12 amps and in an alternative embodiment, may be in the range of 24 amps. Thus, the voltage drop experienced on conductor 368 will vary greatly with the variation in the current drawn because the voltage drop is directly proportional to the amount of current being drawn. If one desires to know the actual voltage on common electrode 344, measuring the voltage VDD at the distant end of the first electrode power supply 368 has been found according to principles of the present invention to not be sufficiently close in voltage value to be acceptable for the type of control desired to provide a high quality print output, this technique being a technique which has been previously used in the prior art.

According to principles of the present invention, a remote sense electrode 360 is connected to the common electrode 344 at a position in proximity to the first conductive traces 340, as shown in FIG. 6B. The distal end of the remote sense electrode 360 is connected to a voltage sense pin 341 (see connector 330 of FIG. 5) which is dedicated solely to sensing the voltage. Pin 341 is not used as a power supply pin for the heating current. The voltage sense pin 341 is connectable to a voltage sense circuit to permit sensing the voltage of the first end of the thermal print elements 102 using a conductive path which is different from the conductive path used to conduct a heating current from the power supply to heat the thermal print elements 102. The voltage sensing circuit is preferably of a type which draws a constant current at all times. In a preferred embodiment, the current drawn by the voltage sensing circuit is approximately zero (in some embodiments, the current drawn may be so low that it may be approximated to be equal to zero at all times when compared to the current drawn by other portions of the circuit). That is, the sensing current $I_S$ is a constant current and is preferably approximately zero. This results in the sensing voltage $V_S$ having a constant relationship with respect to the voltage of the common electrode 344. If the voltage of the common electrode 344 suddenly decreases, this decrease will be instantly sensed by the voltage sensing circuit connected to $V_S$ through the voltage sense pin 341. Corrective action can then be taken as previously described herein to maintain high quality print.

FIG. 6C illustrates alternative embodiments toward the position of the connection point 373 between the remote sense electrode 360 and the common conductor 344. According to a preferred embodiment, the connection point 373 between the remote sense electrode 360 and the common electrode 344 is positioned at a distance X from the side edge of the common electrode 344. Positioning the connection point 373 a distance X from the side edge of the common conductor 344 permits the voltage to be more accurately sensed across the entire common conductor 344 and in closer proximity to the average distance from the conductive traces. While the embodiment of FIG. 6B is suitable in many applications, the embodiment of FIG. 6C is advantageous in some applications, particularly those in which a large number of conductive traces 340 may be present.

According to one preferred embodiment of the type shown in FIG. 6C, the distance X is approximately one-half of the width of the common electrode 344 so as to position the connection point 373 of the remote sense electrode 360 to the common electrode 344 approximately at the center of the common electrode 344. This results in having an approximately equal number of conductive traces 340 on either side of the connection point 373. In other embodiments, the distance X may be one-third of the distance from the side edge of the common electrode 344 or positioned at another acceptable distance from the side edge of the common electrode 344. Other acceptable distances can be selected based on the particular application or particular use of the printhead. For example, the connection point 373 can be selected proximal to the location of the maximum voltage drop across the printhead. Alternatively, the connection point 373 can be selected approximately at a point of the mean voltage drop across the printhead. (The point of maximum voltage drop across the printhead may vary with the printhead design, or alternatively with the use of the printhead. For example, if the printhead is being used in an environment in which bar code is being printed at one end of the printhead and text is being printed by another portion of the printhead on a consistent basis with each use, it is reasonable to assume that the printhead elements that are printing the bar code pattern will be more heavily used than the printhead elements which are used to print the text. Based on this assumption, a maximum point of voltage drop can be determined.) The point of maximum voltage drop and the points, usually two, of mean voltage drop can be determined using any other of the many techniques that are presently known to those of ordinary skill in the art.

FIG. 6D illustrates a further alternative embodiment having a plurality of remote sense electrodes 360*a*, 360*b*, 360*c*, etc. This alternative embodiment of FIG. 6D is particularly useful in an extremely large printhead or one in which the heating current patterns may vary widely from one end of the printhead to the other. In some printheads, the local voltage of the common electrode 344 may vary across the single conductive strip that forms the common electrode 344. For such printheads, it may be useful to provide a plurality of remote sense electrodes 360 as shown 360*a*, 360*b*, and 360*c* to permit accurately measuring the voltage on the common electrode 344 at a more exact position. A plurality of dedicated voltage sense pins 341*a*, 341*b*, and 341*c* can be provided to be connected to the sense conductors, respectively, the voltage sense pins being connectable to respective voltage sensing circuits to permit the sensing of the voltage of the first end of the thermal print elements 102 proximal to each respective remote sense electrode 360*a*, 360*b*, 360*c*, etc. using a conductive path different from each other and also different from the conductive path used to conduct current from the power supply to heat the thermal print elements 102.

In one alternative embodiment, a remote ground sense electrode 362 is also provided. As previously described, the power ground electrode 367 carries the power current to ground for those resistive thermal print elements 102 which have been selected. Generally, the ground connection 367 will have sufficient current carrying capabilities that ground will be held at a solid value and will not vary. However, in some embodiments, it is preferred to provide a separate remote ground sense electrode 362 to sense the exact value of the ground potential. The remote ground sense electrode 362 will be connected to a voltage sense pin 343 so that the ground voltage $V_{RSG}$ can be accurately sensed for those embodiments in which this is desired. The current $I_{RSG}$ is of a constant value, and preferably has a relative value of approximately zero so that the voltage sensed at $V_{RSG}$ is approximately equal to the actual ground voltage and is at least always exactly proportional to this voltage. Thus, in this alternative embodiment of FIG. 6B, the ground voltage on the ground electrode 369 and the voltage of the common electrode 344 can both be accurately sensed and the difference between the two voltages determined.

The printhead embodiment which has been described is one in which the common electrode 344 is connected to the higher voltage power supply and the selection switches are interposed between the ground power supply and the ground traces. In some printheads, such as those using the reverse voltage configuration, the selection switches 316 are positioned between the high voltage power supply and the printhead elements, and the ground electrode is the common electrode. In this alternative embodiment, the third conductor, which is the voltage sense conductor, is connected to the ground electrode. Thus, the side from which the voltage is sensed is the side which has all of the electrodes connected in common.

As indicated above, a detailed illustrative embodiment is disclosed herein. However, other embodiments, which may be detailed rather differently from the disclosed embodiments, are possible. Consequently, the specific structural and functional details disclosed herein are merely representative: yet in that regard, they are deemed to afford the best embodiments for the purposes of disclosure and to provide a basis for the claims herein, which define the scope of the present invention.

We claim:

1. A printhead for a thermal printer comprising:

a plurality of individual thermal print elements, each thermal print element having a first end and a second end and each being responsive to increase in temperature in response to a current passing therethrough;

a common electrode having a voltage variation in response to an expected pattern of printing activity of the print element;

a plurality of supply lines, each coupled between the common electrode and a respective first end of each thermal print element;

a first electrical conductor connected to the common electrode for providing electrical power to the selected ones of the thermal print elements;

a power supply pin connected to the first electrical conductor for coupling to a first voltage terminal of a power supply;

a second electrical conductor being coupleable to the second ends of the plurality of thermal print elements;

a reference power supply pin connected to the second electrical conductor for attachment to a reference terminal of the power supply for completing a current path through the power supply pin, through the first electrical conductor, through the common electrode, through the selected thermal print elements, through the second electrical conductor, and through the reference power supply pin;

a sense conductor connected to the common electrode at a connection position in proximity to the supply lines such that said sense conductor is at a voltage potential approximately equal to the voltage potential of the first end of the thermal print elements, the connection position further being spaced a distance x from a lateral edge of the common electrode, the distance X being selected as a function of the voltage variation, the sense conductor providing a voltage sense signal path to the first ends of the thermal print elements separate from the current path; and a voltage sense pin connected to the sense conductor for sensing the voltage of the first end of the thermal print elements using the voltage sense signal path.

2. The printhead of claim 1 wherein the distance x is selected to place the connection position proximal to a point of expected maximum voltage drop across the printhead.

3. The printhead of claim 1 wherein the distance x is selected to place the connection position at a point of expected mean voltage drop across the printhead.

4. The printhead of claim 1, further comprising a plurality of sense conductors connected to the common electrode at positions in proximity to the supply lines such that a voltage potential sensed by each of said sense conductors is approximately equal to the voltage potential of the first end of the thermal printheads connected to the supply lines to which each is proximally located, respectively; and a plurality of voltage sense pins connected to the sense conductors respectively, the voltage sense pins for sensing the voltage of the first end of the thermal print elements proximal to each respective sense conductor using respective conductive paths different from the current path used to conduct current from the power supply.

5. A thermal printhead assembly, comprising:

a plurality of print elements each having a first end and a second end, the print elements being responsive to produce heat in response to a current passing therethrough;

a common conductor electrically coupled to the first ends;

a first power conductor electrically coupled to the common conductor and extending from the common conductor for applying a power signal to the common conductor;

a second power conductor coupleable to the second ends such that current flowing through the first power conductor and the print elements passes through the second power conductor; and a plurality of sense lines electrically coupled to the common conductor and separate from the first and second power conductors, the sense lines being coupled at respective spaced apart locations on the common conductor.

6. The printhead assembly of claim 5 wherein the print elements include an expected heating distribution having an expected mean location, wherein one of the spaced apart locations on the common conductor is positioned at the expected mean location.

7. The printhead assembly of claim 5 wherein one of the spaced apart locations on the common conductor is positioned at the midpoint of the common conductor.

8. The printhead assembly of claim 5 wherein the common conductor includes an expected location of maximum voltage drop and wherein one of the spaced apart locations on the common conductor is positioned at the expected location of maximum voltage drop.

9. The printhead assembly of claim 8 wherein the common conductor includes an expected location of mean voltage drop and wherein one of the spaced apart locations on the common conductor is positioned at the expected location of mean voltage drop.

10. The printhead assembly of claim 5, further including a plurality of sense pins coupled to respective ones of the sense lines at opposite ends of the sense lines from the respective spaced apart locations.

11. A thermal printer, comprising:

an electronic controller;

a printhead having a plurality of print elements each having a first end and a second end, the print elements being responsive to produce heat in response to a current passing therethrough;

a power supply having a first terminal and a second terminal for providing a driving current to the print elements;

a common conductor electrically coupled to the first ends, the common conductor having an expected location of mean voltage drop;

a first power conductor electrically coupled between the first terminal and the common conductor;

a second power conductor coupled between the second terminal and the second ends;

a switching assembly coupled to the first or second ends and operative to control current through the print elements in response to a control signal; and a first sense line electrically coupled to the common conductor and separate from the power conductor, the first sense line being coupled to the electronic controller and to the common conductor at the location of expected mean voltage drop.

12. The printer of claim 11, further including a plurality of other sense lines coupled between the common conductor and the electronic controller, the other sense lines being coupled to the common conductor at a respective location, spaced apart from each other and from the location of the expected mean voltage drop.

13. The printer of claim 12 wherein the common conductor includes an expected location of maximum voltage drop and wherein one of the other sense lines is coupled to the common conductor at the expected location of maximum voltage drop.

14. The printer assembly of claim 11 further including a second sense line coupled between the switching assembly and the electronic controller.

15. The printer of claim 14 wherein the electronic controller includes a voltage monitoring circuit coupled to detect a voltage difference between the first and second sense lines.

16. The printer of claim 15 wherein the electronic controller is responsive to adjust a heating schedule of the print elements in response to the detected voltage between the first and second sense lines.

17. The printer of claim 15 wherein the electronic controller is coupled to the power supply and wherein the electronic controller is responsive to adjust an output voltage of the power supply in response to the detected voltage between the first and second sense lines.

18. A method of controlling heating in a thermal printhead having a plurality of thermal print elements coupled to a common electrode, comprising the steps of:

supplying an input power signal to the common electrode through a first conductive path;

selecting a location on the common electrode having an expected average voltage drop;

monitoring a voltage of the selected location through a second conductive path different from the first conductive path; and adjusting the input power signal in response to the monitored voltage.

19. The method of claim 18, further comprising the steps of:

selecting a second location on the common electrode having an expected maximum voltage drop;

monitoring a voltage of the selected second location through a third conductive path different from the first and second conductive paths; and adjusting the input power signal in response to the monitored voltages of the first and second selected locations.

20. A method of controlling heating in a thermal printhead having a plurality of thermal print elements coupled to a common electrode, comprising the steps of:

supplying an input power signal to the common electrode through a first conductive path;

selecting a plurality of spaced apart locations on the common electrode;

monitoring voltages of the selected locations through a plurality of separate other conductive paths different from the first conductive path; and adjusting the input power signal in response to the monitored voltages.

21. The method of claim 20, further wherein the step of selecting a plurality of locations on the common electrode comprises the steps of:

determining a location of expected maximum voltage drop; and selecting the determined location as one of the selected locations.

22. The method of claim 20, further wherein the step of selecting a plurality of locations on the common electrode comprises the steps of:

determining a location of expected mean voltage drop; and selecting the determined location as one of the selected locations.

* * * * *